US005594308A

United States Patent [19]

Nuckolls et al.

[11] Patent Number: 5,594,308

[45] Date of Patent: Jan. 14, 1997

[54] HIGH INTENSITY DISCHARGE LAMP STARTING CIRCUIT WITH AUTOMATIC DISABLEMENT OF STARTING PULSES

[75] Inventors: Joe A. Nuckolls; Isaac L. Flory, IV, both of Blacksburg, Va.

[73] Assignee: Hubbell Incorporated, Orange, Conn.

[21] Appl. No.: 520,514

[22] Filed: Aug. 29, 1995

[51] Int. Cl.[6] ..... H05B 41/14

[52] U.S. Cl. ..... 315/290; 315/209 SC; 315/205; 315/276; 315/DIG. 5

[58] Field of Search ..... 315/209 SC, 205, 315/276, 289, 290, DIG. 5

[56] References Cited

U.S. PATENT DOCUMENTS

| | | | |
|---|---|---|---|
| 3,249,807 | 5/1966 | Nuckolls | 315/199 |
| 3,317,789 | 5/1967 | Nuckolls | 315/194 |
| 3,710,184 | 1/1973 | Williams | 315/227 |
| 3,857,060 | 12/1974 | Chermin | 315/99 |
| 3,917,976 | 11/1975 | Nuckolls | 315/199 |
| 3,963,958 | 6/1976 | Nuckolls | 315/276 |
| 3,997,814 | 12/1976 | Toho | 315/200 |
| 4,015,167 | 3/1977 | Samuels | 315/99 |
| 4,017,761 | 4/1977 | Woldring | 315/99 |
| 4,209,730 | 6/1980 | Pasik | 315/290 |
| 4,378,514 | 3/1983 | Collins | 315/276 |
| 4,562,381 | 12/1985 | Hammer et al. | 315/99 |
| 4,626,745 | 12/1986 | Davenport et al. | 315/179 |
| 4,866,347 | 9/1989 | Nuckolls et al. | 315/158 |
| 4,885,507 | 12/1989 | Ham | 315/244 |
| 4,891,562 | 1/1990 | Nuckolls et al. | 315/277 |
| 4,914,354 | 4/1990 | Hammer et al. | 315/247 |
| 4,958,107 | 9/1990 | Mattas et al. | 315/289 |
| 4,994,718 | 2/1991 | Gordin | 315/240 |
| 5,047,694 | 9/1991 | Nuckolls et al. | 315/290 |
| 5,049,789 | 9/1991 | Kumar et al. | 315/289 |
| 5,216,333 | 6/1993 | Nuckolls et al. | 315/291 |
| 5,309,065 | 5/1994 | Nuckolls et al. | 315/205 |
| 5,321,338 | 6/1994 | Nuckolls et al. | 315/290 |

FOREIGN PATENT DOCUMENTS

| | | |
|---|---|---|
| 5218077 | 2/1977 | Japan . |
| 5218078 | 2/1977 | Japan . |
| 5249678 | 4/1977 | Japan . |
| 5498066 | 8/1979 | Japan . |

OTHER PUBLICATIONS

Philips Lighting, "IFS 800 Lighting Control System", (Oct. 1990).

Rudd Lighting, "There's One System That Makes Two Level Lighting Simple". (1993).

*Primary Examiner*—Robert Pascal
*Assistant Examiner*—David H. Vu
*Attorney, Agent, or Firm*—Jerry M. Presson; John E. Holmes

[57] ABSTRACT

A hot restart circuit for a high intensity discharge lamp includes a storage capacitor and SCR connected across a tapped portion of a ballast with a breakdown device to start the SCR. A charging circuit for the storage capacitor includes a diode, a pumping capacitor and an RF choke in series from the ballast tap to the AC line, and a further diode interconnecting the capacitors. The pumping capacitor increases the charge on the storage capacitor in a stepwise fashion until breakdown voltage is reached, whereupon starting pulses are applied to the lamp. A positive temperature coefficient (PTC) resistor stops the flow of charging current to the capacitors after a predetermined interval, thereby terminating the reignition pulses and protecting the starting circuit from damage in case the lamp fails to reignite. In an alternative embodiment, a MOSFET gated by an RC timing circuit removes charge from the storage capacitor in order to terminate the reignition pulses after a predetermined interval.

21 Claims, 1 Drawing Sheet

HIGH INTENSITY DISCHARGE LAMP STARTING CIRCUIT WITH AUTOMATIC DISABLEMENT OF STARTING PULSES

FIELD OF THE INVENTION

The present invention relates to an improved circuit for starting, operating and hot restarting a high pressure sodium (HPS) lamp or other high intensity discharge lamp using a voltage multiplying circuit which is automatically disabled if the lamp fails to ignite within a predetermined interval.

BACKGROUND OF THE INVENTION

As is well known in the art, high pressure sodium (HPS) lamps are difficult to start and require special circuitry for restarting if the lamp is extinguished after sufficient operation to elevate its temperature. This is normally known as hot restarting and is known to require high voltage and energy across the lamp, considerably higher than can be provided by the line operating voltage.

In commonly-assigned U.S. Pat. Nos. 5,047,694 and 5,321,338, various hot restarting circuits for HPS and other high intensity discharge lamps are described. These circuits include a storage capacitor and an SCR connected across a tapped portion of a ballast with a breakdown device to start the SCR. A charging circuit for the storage capacitor includes a diode, a pumping capacitor and a choke connected in series from the ballast tap to the AC line, and a further diode interconnecting the capacitors. The pumping capacitor increases the charge on the storage capacitor in a stepwise fashion until the breakdown voltage is reached, whereupon energy in the form of high voltage starting pulses is applied to the lamp.

In cases where a high intensity discharge lamp is defective or is otherwise incapable of starting, it is desirable to automatically disable the starting circuit after a certain period of time in order to prevent damage to the dielectric components of the circuit from repeated high voltage pulses. The aforementioned U.S. Pat. Nos. 5,047,694 and 5,321,338 disclose two ways in which this may be accomplished. In one embodiment, a thermostatic switch is connected in series between the pumping capacitor and storage capacitor and is opened by an associated heating resistor after a certain period of time (approximately 3 to 5 minutes) to terminate the stepwise charging of the storage capacitor. Although this is an effective arrangement, it has the disadvantage that the disablement time will depend to some extent on the ambient temperature at the luminaire, which can range from −30° C. for an outdoor installation to more than +90° C. when the HPS lamp is operating. In a second embodiment, which does not have this disadvantage, the disabling circuit is electronic in operation rather than thermal. In this embodiment, a capacitor having a value much larger than that of the storage capacitor is used to slowly accumulate a charge that opposes the charge on the storage capacitor, eventually preventing the storage capacitor from attaining the necessary breakdown voltage. In the specific embodiment disclosed, the high voltage starting pulses are generated every 0.45 second and are terminated by the disabling circuit after 4 pulses have occurred. Despite its temperature insensitivity, however, the capacitive disabling circuit is disadvantageous in that it requires a high value capacitor (on the order of 100 microfarads) which is not only expensive, but is physically large and difficult to fit onto the same circuit board with other HPS starting components.

SUMMARY OF THE INVENTION

A primary object of the present invention is to provide a hot restarting circuit for a high intensity discharge lamp which, in the case of a failed lamp, is automatically disabled after a predetermined interval that is accurately predictable and substantially independent of temperature.

A further object of the invention is to provide a hot restarting circuit for a high intensity discharge lamp which is relatively simple in construction, and does not require the use of expensive or physically large components.

The foregoing objects are substantially achieved by providing an apparatus for starting and operating a high intensity discharge lamp which comprises, in combination, a pair of input terminals for supplying voltage to the apparatus, a pair of output terminals for connection to a high intensity discharge lamp, a step-up transformer for coupling the input terminals to the output terminals, and a voltage multiplier circuit coupled to a primary winding of the transformer. The voltage multiplier circuit comprises a device for blocking high-frequency current, a first capacitor and a first rectifier element connected in a first series circuit with the device for blocking high-frequency current to the primary winding, a second capacitor and a second rectifier element connected in a second series circuit with the device for blocking high-frequency current to the primary winding, and a voltage response switching device connected in a closed-loop series circuit with the second capacitor and the primary winding. When the second capacitor is charged to the breakdown voltage of the switching device, the switching device becomes conductive to provide a discharge path for the second capacitor through the primary winding, thereby inducing in the secondary winding of the transformer a high voltage pulse for igniting a discharge lamp connected to the output terminals. The voltage multiplier circuit also includes an inhibiting circuit for inhibiting the action of the second capacitor and starting of the lamp after a predetermined interval if the lamp has not ignited. The inhibiting circuit comprises a positive temperature coefficient resistor connected in series with at least one of the first and second series circuits, and may also include a third rectifier element connected between the positive temperature coefficient resistor and the primary winding for conducting a heating current through the positive temperature coefficient resistor during alternate half-cycles of the supply voltage.

In accordance with another aspect of the present invention, an apparatus for starting and operating a high intensity discharge lamp comprises, in combination, a pair of input terminals for supplying voltage to the apparatus, a pair of output terminals for connection to a high intensity discharge lamp, a step-up transformer for coupling the input terminals .to the output terminals, and a voltage multiplier circuit coupled to a primary winding of the transformer. The voltage multiplier circuit comprises a device for blocking high-frequency current, a first capacitor and a first rectifier element connected in a first series circuit with the device for blocking high-frequency current to the primary winding, a second capacitor and a second rectifier element connected in a second series circuit with the device for blocking high-frequency current to the primary winding, and a voltage response switching device connected in a closed-loop series circuit with the second capacitor and the primary winding. When the second capacitor is charged to the breakdown voltage of the switching device, the switching device becomes conductive to provide a discharge path for the second capacitor through the primary winding, thereby inducing in the secondary winding of the transformer a high voltage pulse for igniting a discharge lamp connected to the output terminals. The voltage multiplier circuit also includes an inhibiting circuit for inhibiting the action of the second capacitor and starting of the lamp after a predetermined interval if the lamp has not ignited. The inhibiting circuit comprises a controlled switching device which is connected across the second capacitor for discharging the second capacitor when a predetermined voltage is applied to a control terminal of the switching device, and a third capacitor connected to the control terminal for applying the predetermined voltage to the control terminal. Preferably, the third capacitor is connected to the second capacitor so as to be charged by the second capacitor.

In accordance with another aspect of the present invention, a method for starting and operating a high intensity discharge lamp comprises the steps of receiving an input AC voltage waveform from an AC source; during a first polarity half-cycle of the input AC voltage waveform, charging a first capacitance through a first rectifier element; during a second polarity half-cycle of the input AC voltage waveform, charging a second capacitance through a second rectifier element and transferring charge from the first capacitance to the second capacitance; repeating the preceding method steps to stepwise charge the second capacitance until the second capacitance reaches a predetermined potential in excess of the peak magnitude of the input AC voltage waveform; upon the second capacitance reaching the predetermined potential, discharging the second capacitance through a primary winding of a step-up transformer to induce a high voltage pulse in a secondary winding of the transformer; coupling the high voltage pulse to a high intensity discharge lamp to ignite the lamp; repeating the preceding method steps to generate and couple a plurality of successive high voltage pulses to the high intensity discharge lamp; establishing a predetermined time interval by causing current to flow through a temperature dependent resistance; and terminating the generation and coupling of high voltage pulses to the high intensity discharge lamp after the predetermined time interval has expired. Preferably, the temperature dependent resistance comprises a positive temperature coefficient resistance through which at least one of the first and second capacitances is charged.

In accordance with a still further aspect of the present invention, a method for starting and operating a high intensity discharge lamp comprises the steps of receiving an input AC voltage waveform from an AC source; during a first polarity half-cycle of the input AC voltage waveform, charging a first capacitance through a first rectifier element; during a second polarity half-cycle of the input AC voltage waveform, charging a second capacitance through a second rectifier element and transferring charge from the first capacitance to the second capacitance; repeating the preceding method steps to stepwise charge the second capacitance until the second capacitance reaches a predetermined potential in excess of the peak magnitude of the input AC voltage waveform; upon the second capacitance reaching the predetermined potential, discharging the second capacitance through a primary winding of a step-up transformer to induce a high voltage pulse in a secondary winding of the transformer; coupling the high voltage pulse to a high intensity discharge lamp to ignite the lamp; repeating the preceding method steps to generate and couple a plurality of successive high voltage pulses to the high intensity discharge lamp; establishing a predetermined time interval by causing current to flow into a third capacitance through a resistance until a predetermined control voltage is reached; coupling the control voltage to the control input of a controlled switching device to place the controlled switching device into conduction; and terminating the generation and coupling of high voltage pulses to the high intensity discharge lamp after the predetermined time interval has expired by discharging at least one of the first and second capacitances through the controlled switching device.

BRIEF DESCRIPTION OF THE DRAWINGS

Referring now to the drawings, which form a part of the original disclosure.

DETAILED DESCRIPTION OF THE PREFERRED EMBODIMENTS

Figure 1:
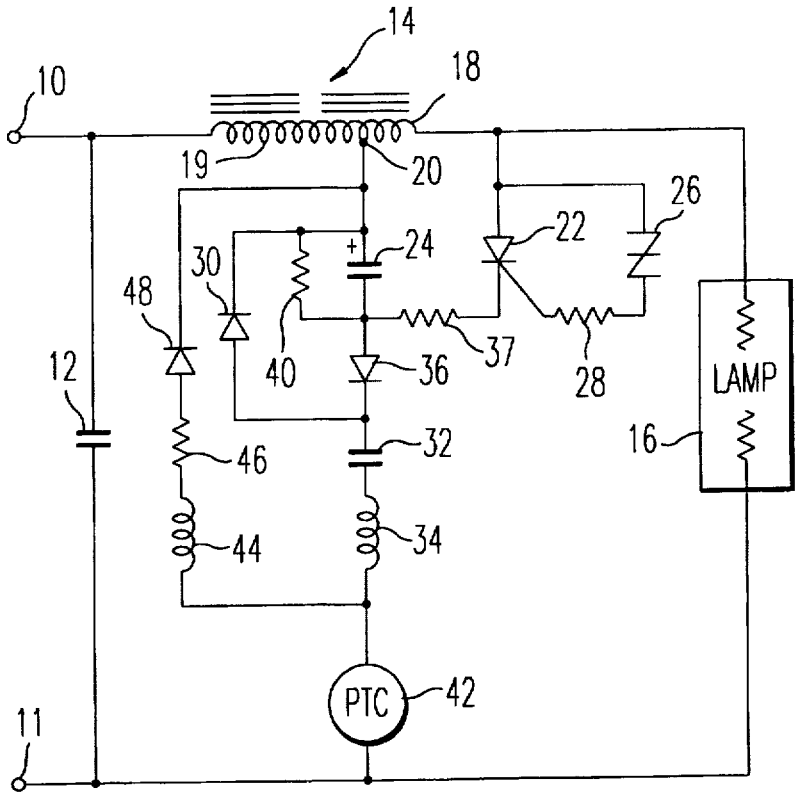
FIG. 1 is a schematic diagram of a hot restarting circuit in accordance with a first embodiment of the present invention.

In the circuit shown in FIG. 1, terminals 10 and 11 are provided so as to be connectable to a suitable AC source which would typically be 240-volt RMS line voltage. A power factor correcting capacitor 12 is connected between terminals 10 and 11 in a conventional manner. An inductive ballast indicated generally at 14 has one end terminal connected to terminal 10 and the other end terminal connected to one terminal of a high pressure sodium (HPS) lamp 16, the other side of lamp 16 being connected to terminal 11. Thus, the ballast 14 and lamp 16 are in series circuit relationship with each other across the AC source terminals 10 and 11.

Ballast 14 is a tapped ballast such that it has a first winding portion 18 and a second winding portion 19 which are inductively coupled, portion 18 constituting a much smaller number of windings than portion 19, preferably on the order of about 5% of the total number of windings of the ballast. A tap 20 is provided at the Junction between winding portions 18 and 19.

A semiconductor switch 22 such as a silicon-controlled rectifier (SCR) or the like is connected so that one end of its switchable conductive path is connected to the end the of first portion 18 of the ballast and a high energy storage capacitor 24 has one end connected to tap 20. The other end of the capacitor is connected to the other end of the conductive path of SCR 22. A sidac 26 or other break-down device is connected between the gate and anode of the SCR 22, a current-limiting resistor 28 being included in series with the sidac 26 if the characteristics thereof require current limitation.

As will be recognized from the circuit thus far described, the SCR 22, capacitor 24 and sidac 26 are connected such that if the voltage on capacitor 24 is increased to a level such that it reaches or exceeds the threshold voltage of the breakdown device, the sidac 26 will become conductive, placing the SCR 22 in a conductive state and discharging the capacitor 24 through winding portion 18. Because the windings are inductively coupled, portion 18 acts as the primary of a transformer, inducing a voltage in the significantly larger winding portion 19, and generating a high voltage therein which is then imposed upon lamp 16. As is well understood from a circuit of this type, proper selection of winding relationship creates a voltage which is sufficiently high to ignite the lamp 16.

A charging circuit for capacitor 24 is connected between tap 20 and terminal 11 at the other side of the AC source. This charging circuit includes a first diode 30, a pumping capacitor 32 and a radio frequency choke 34, these components being connected in series between tap 20 and terminal 11. A second diode 36 is connected between capacitor 24 and capacitor 32 and is poled in the opposite direction from diode 30.

The circuit including SCR 22, sidac 26, capacitors 24 and 32, diodes 30 and 36, and RF choke 34 will be referred to as the starter circuit. The operation of starter circuit is as follows.

During one half-cycle of the AC supply, a current flows through choke 34, capacitor 32 and diode 30 to charge capacitor 32. This capacitor is chosen to be relatively small, significantly smaller than capacitor 24, typically having a value of about 0.068 microfarads. On the next half-cycle, capacitor 24 is charged and the voltage across capacitor 32 aids the incoming source half-wave so as to deliver energy on the order of 3.9 millijoules to storage capacitor 24. Capacitor 24, which can be on the order of 5 microfarads, obviously requires more energy than can be supplied by the incoming source and capacitor 32 in one cycle. Accordingly, on the next half-cycle, capacitor 32 is again charged and again delivers energy to capacitor 24 on the subsequent half-cycle, each subsequent cycle increasing the charge on capacitor 24 in a kind of voltage multiplying or pumping action. With capacitors of the value indicated, approximately 25 cycles are required to charge capacitor 24 to a level of 520 volts, which is a suitable breakdown level for sidac 26.

When the voltage on capacitor 24 reaches the sidac breakdown voltage, the sidac 26 becomes conductive, rendering the SCR conductive and discharging capacitor 24 through winding portion 18, generating the high voltage in winding portion 19. The large-magnitude capacitor 24 releases considerable energy into the magnetic field of the reactor 14 (e.g., 0.676 joules as compared with 0.00063 joules in a more conventional HPS starter), which excites the core of the reactor to a relatively high degree. The highly excited reactor 14 with its corresponding collapsing magnetic field pushes the lamp into complete discharge and into a low impedance state so that the discharge can then be picked up and maintained by the normal AC source. The discharging capacitor 24 produces current flow which is in the same direction as the continued current flow produced by the collapsing field and is forced through the lamp 16 as the SCR 22 is turned off by the instantaneous back voltage bias placed on capacitor 24 by the same collapsing field energy.

In this controlled step-charging of the large energy storage capacitor 24, there is no need for a high wattage, low magnitude series-connected resistor which would produce high-wattage loss. Thus, the circuit is very efficient and does not generate heat.

A 10 ohm wire-wound resistor 37 can be connected in series with SCR 22 to cause the peak of the high-voltage pulse to be lower and the base (width) of the pulse to be longer. This decreases the dielectric stress which allows use of lower cost magnetic components. This added resistance is so small that it does not cause measurable heating.

A bleeder resistor 40 having a resistance value of approximately 4.7 megohms is preferably placed in series across the storage capacitor 24 as shown. When the lamp 16 is deenergized, the bleeder resistor 40 discharges the storage capacitor 24 in order to prevent service personnel from being exposed to a potentially hazardous voltage.

When the SCR 22 becomes conductive, the high voltage generated across the ballast is also imposed on the RF choke 34 as well as the lamp 16. The RF choke 34 offers a very high impedance at the pulse frequency, thus assuring that the majority of the voltage appears across the lamp 16 and protecting the components of starting circuit from this high voltage. Capacitor 12 also serves as a high frequency bypass to cause the high voltage to appear across the lamp's distributed capacitance system. If the lamp 16 for some reason fails to reignite, the high voltage cycle described above repeats approximately every 3 seconds until the lamp 16 starts. The lamp normally starts with the first pulse, but sometimes two or three pulses are required. When the lamp 16 reignites, the operating voltage of the lamp 16 clamps the voltage across the starting circuit to approximately 110 volts, thereby automatically turning off the high voltage generating process during lamp operation.

If the lamp 16 is defective or otherwise fails to reignite, it is desirable to automatically disable the hot starting circuit in order to prevent damage to its components (and to other dielectric components of the circuit, such as wire insulation, wire enamel, lamp socket, lamp base, and so on) from repeated high voltage pulsing. For this purpose, an automatic disabling circuit comprising a positive temperature coefficient (PTC) resistor 42, a radio frequency choke 44, a 1250-ohm resistor 46 and a diode 48 is provided. All of these elements are connected in series, as shown, between the input terminal 11 and the tap 20 of the ballast 14. The node between the PTC resistor 42 and the radio frequency choke 44 is connected to the lower terminal of the radio frequency choke 34. In this way, all of the charging current for the capacitors 24 and 32 flows through the PTC resistor 42. The circuit comprising the radio frequency choke 44, resistor 46 and diode 48 provides a source of half-wave heating current for the PTC resistor 42 that bypasses the charging circuitry for the capacitors 24 and 32.

When the lamp 16 is first energized, the PTC resistor 42 has a resistance of approximately 82 ohms, which is very low relative to the charging circuit impedance of approximately 39 kilohms. Thus, charging of the capacitors 24 and 32 proceeds as normal. The small charging current drawn by the capacitors 24 and 32 does not cause significant heating of the PTC resistor 42 and thus does not appreciably change its resistance. However, the half-wave current which flows through the PTC resistor 42 via the RF choke 44, resistor 46 and diode 48 has a relatively high magnitude, and causes the resistance of the PTC resistor 42 to reach approximately 85 kilohms or more within 35 seconds. This resistance value is sufficiently high to terminate further charging of the capacitors 24 and 32, and hence the high voltage pulsing of the lamp 16 ceases. In this way, damage to the starting circuit, lamp socket and leads is prevented in the event that the lamp 16 fails to reignite for some reason. As long as the secondary voltage of the ballast 14 is maintained by power applied at the input terminals 10 and 11, the half-wave heating of the PTC resistor 42 through the circuit elements 44, 46 and 48 continues (at a much reduced level) and the PTC resistor 42 remains in its high-resistance state. This prevents the generation of further high voltage pulses by the starting circuit. In the preferred embodiment, the 35 second disablement period allows for approximately 12 high voltage reignition pulses before disablement of the starting circuit occurs. If a hot restart of the lamp 16 does not occur after 12 tries, it may for all practical purposes be regarded as defective.

When the lamp 16 is operating normally, the voltage across the series circuit comprising the elements 42, 44, 46 and 48 is clamped to the lamp voltage of approximately 110 volts. Under these conditions, the heating of the PTC resistor drops to 21% of the 240-volt rate, and the PTC resistor 42 cools down. Thus, the PTC resistor 42 goes to and remains in a low resistance state and the reignition process can occur if the lamp 16 drops out for some reason. Similarly, if reignition has already been attempted without success, removal of power from the input terminals 10 and 11 will allow the PTC resistor 42 to cool and revert to its low resistance state, whereupon reignition will be attempted once again when power is restored to the input terminals 10 and 11.

The hot start disablement circuit comprising the components 42, 44, 46 and 48 of FIG. 1 has a number of advantages. All of the components of the circuit are relatively inexpensive and, equally importantly, are sufficiently small in physical size to be mounted on the same circuit board that is used for the other components of the starting circuit. Also, since the temperature variation of the PTC resistor 42 between its low and high resistance states (a span of approximately 150° C.) is greater than the normal range of ambient temperatures to which the circuit will be exposed, the operation of the disablement circuit is essentially insensitive to temperature. In the high resistance state of the PTC resistor 42, power loss in the heating circuit drops to less than one watt, thereby making the circuit self-protecting against thermal runaway. It will also be appreciated that the use of the RF choke 44 in the heating circuit isolates the components of the heating circuit from the high voltage pulses produced by the starting circuit.

In actual embodiments of the circuit shown in FIG. 1, nominal line voltage of 240 volts AC at the input terminals 10 and 11 has been found to result in the occurrence of 12 high voltage reignition pulses through the lamp 16 over an interval of 35 seconds before disablement of the starting circuit occurs. When the line voltage is reduced by 10% from its nominal value, the number of reignition pulses drops to 11 and the disablement interval is increased to approximately 50 seconds. Conversely, when the line voltage increases by 10% from its nominal value, the disablement period is reduced to 28 seconds but the number of reignition pulses remains the same at 12. Thus, it will be appreciated that the number of reignition pulses produced by the circuit of FIG. 1 is relatively insensitive to line voltage fluctuations. It has also been found that power dissipation by the 1250 ohm resistor 46 in the circuit of FIG. 1 is only approximately 0.1 watt during normal operation of the lamp 16, and hence the disablement circuit does not cause any significant reduction in efficiency.

A number of modifications are possible in the disablement circuit illustrated in FIG. 1. For example, the PTC resistor 42 can be relocated to a different point in the circuit. Alternatively, the PTC resistor 42 can be replaced with another type of thermistor device such as a negative temperature coefficient (NTC) resistor. The NTC resistor can be placed in series with a high resistance (e.g., 1 megohm) and connected across the terminals of the storage capacitor 24 to bleed charge from the storage capacitor 24 and thereby prevent the generation of high-voltage reignition pulses. A heating current circuit similar to the circuit comprising the components 44, 46 and 48 may be provided for heating the NTC resistor.

Figure 2:
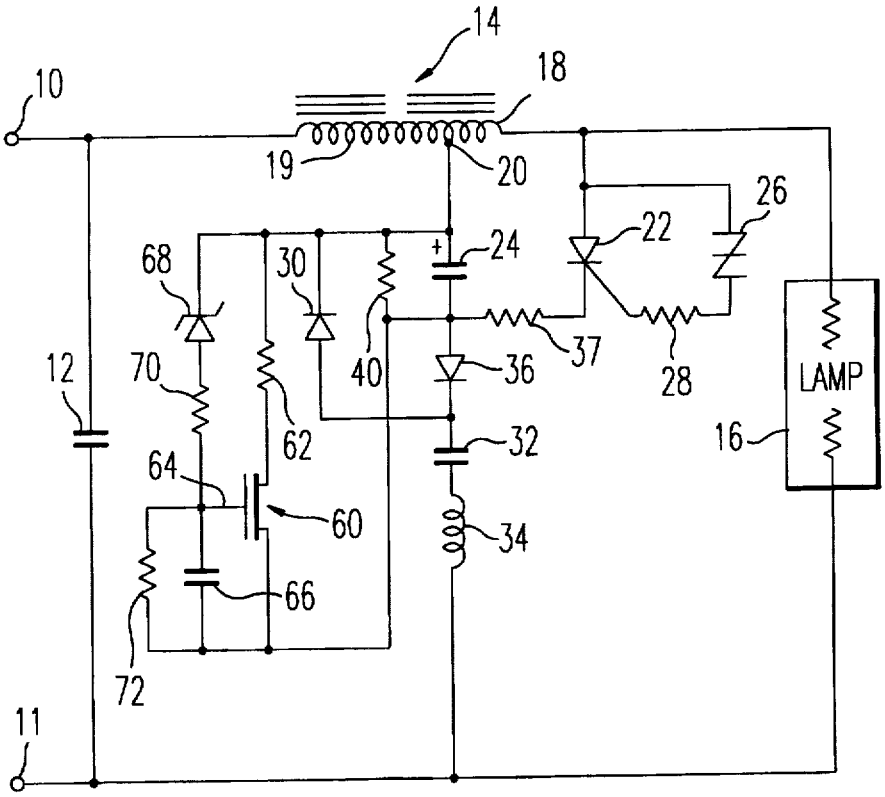
FIG. 2 is a schematic diagram of a hot restarting circuit in accordance with a second embodiment of the present invention.

FIG. 2 illustrates a second embodiment of a reignition disablement circuit in accordance with the present invention. In this embodiment, an N-channel metal oxide semiconductor field-effect transistor (MOSFET) 60 is connected in series with a resistor 62 across the terminals of the storage capacitor 24. The gate terminal 64 of the MOSFET 60 is connected to the positive terminal of a capacitor 66 which is charged from the positive terminal of the capacitor 24 through a zener diode 68 and a resistor 70. During hot restarting of the lamp 16, the capacitor 66 is charged through the resistor 70 at a slow rate. When the capacitor 66 reaches a voltage of approximate 3 volts, the MOSFET 60 begins to conduct and removes charge from the storage capacitor 24 through the resistor 62. The reduction in voltage across the capacitor 24 disables the hot restarting circuit and prevents further high voltage pulses from being applied to the lamp 16. With proper selection of component values, this disablement will occur within approximately 30 seconds after power is applied to the input terminals 10 and 11. The zener diode 68 provides a blocking voltage of 300 volts and prevents the capacitor 66 from charging during normal operation of the lamp 16. Following disablement, the hot restarting circuit can be reset by removing power from the input terminals 10 and 11, which allows the capacitor 66 to discharge through the resistor 72.

Preferred values for the electrical components used in the circuits of FIGS. 1 and 2 are provided in Table 1 below. Resistor values are expressed in ohms (Ω), kilohms (KΩ) or megohms (MΩ). All resistors are ¼-watt unless otherwise noted. Capacitor values are expressed in microfarads (μF) or picofarads (pF), and inductor values are expressed in millihenries (mH).

TABLE 1

| Component | Value or Type |
|---|---|
| Ballast 14 | HPS Lamp Ballast |
| SCR 22 | S6025R |
| Capacitor 24 | 5 μF |
| Sidac 26 | MK1V (4 in series, total breakdown voltage 480–540 volts) |
| Resistor 28 | 680Ω |
| Diodes 30, 36, 48 | 1N5406 (2 in series) |
| Capacitor 32 | 0.068 μF |
| RF chokes 34, 44 | 55 mH (2 in series) |
| Resistor 37 | 10Ω |
| Resistor 40 | 4.7 MΩ |
| PTC Resistor 42 | PTH60H02AR820M265 (82Ω, 0.5 A, 26 watt) |
| Resistor 46 | 1250Ω (8 watt, wirewound) |
| MOSFET 60 | MTP6N60 (600 volt, N-channel) |
| Resistor 62 | 10 KΩ |
| Capacitor 66 | 220 μF |
| Zener diode 68 | 1N5933A (2 in series, total boldoff voltage 300 volts) |
| Resistor 70 | 4.7 MΩ |
| Resistor 72 | 1.5 MΩ |

While only a limited number of exemplary embodiments have been chosen to illustrate the present invention, it will be understood by those skilled in the art that various modifications can be made therein. All such modifications are intended to fall within the spirit and scope of the invention as defined in the appended claims.

What is claimed is:

1. An apparatus for starting and operating a high intensity discharge lamp, comprising the combination of:

a pair of input terminals for supplying voltage to the apparatus;

a pair of output terminals for connection to said high intensity discharge lamp;

a step-up transformer for coupling said input terminals to said output terminals;

a voltage multiplier circuit coupled to a primary winding of said transformer, said voltage multiplier circuit comprising:

a device for blocking high-frequency current;

a first capacitor and a first rectifier element connected in a first series circuit with said device for blocking high-frequency current to said primary winding;

a second capacitor and a second rectifier element connected in a second series circuit with said device for blocking high-frequency current to said primary winding;

a voltage responsive switching device connected in a closed-loop series circuit with said second capacitor and said primary winding, whereby when said second capacitor is charged to the breakdown voltage of said switching device, said switching device becomes conductive to provide a discharge path for said second capacitor through said primary winding, thereby to induce in a secondary winding of said transformer a high voltage pulse for igniting a discharge lamp connected to said output terminals; and an inhibiting circuit for inhibiting the action of said second capacitor and starting of said lamp after a predetermined interval if said lamp has not ignited, said inhibiting circuit comprising a positive temperature coefficient resistor connected in series with at least one of said first and second series circuits and a current path through said positive temperature coefficient resistor for conducting a separate heating current which does not flow as charging current to either of said first and second capacitors.

2. An apparatus as claimed in claim 1, wherein said current path includes a third rectifier element connected between said positive temperature coefficient resistor and said primary winding for conducting a heating current through said positive temperature coefficient resistor during alternate half-cycles of said supply voltage.

3. An apparatus as claimed in claim 2, wherein said current path further includes a current limiting resistor connected in series with said positive temperature coefficient resistor and said third rectifier element for limiting the heating current through said positive temperature coefficient resistor.

4. An apparatus as claimed in 3, further comprising a second device for blocking high-frequency current connected in series with said positive temperature coefficient resistor, said third rectifier element and said current limiting resistor.

5. An apparatus as claimed in claim 1, wherein:

said step-up transformer comprises an autotransformer connected between a first one of said input terminals and one of said output terminals;

said first series circuit is connected between a tap on the winding of said transformer and a second one of said input terminals; and said second series circuit is connected between said tap and said second one of said input terminals.

6. An apparatus according to claim 1, wherein said first and second rectifier elements are oppositely polarized as viewed from a common terminal of said device for blocking high-frequency current.

7. An apparatus according to claim 1, wherein said device for blocking high-frequency current comprises an RF choke.

8. An apparatus as claimed in claim 1, wherein said step-up transformer comprises an autotransformer connected between a first one of said input terminals and one of said output terminals and having a tap point connected to said voltage multiplier circuit, said autotransformer having a winding with an inductance value sufficient to provide a current limiting ballast for the discharge lamp in the normal operation of said lamp.

9. An apparatus as claimed in claim 1, wherein said first and second capacitors have capacitance values of $C_1$ and $C_2$, respectively, and wherein $C_2 >> C_1$.

10. An apparatus for starting and operating a high intensity discharge lamp, comprising the combination of:

a pair of input terminals for supplying voltage to the apparatus;

a pair of output terminals for connection to said high intensity discharge lamps;

a step-up transformer for coupling said input terminals to said output terminals;

a voltage multiplier circuit coupled to a primary winding of said transformer, said voltage multiplier circuit comprising:

a device for blocking high-frequency current;

a first capacitor and a first rectifier element connected in a first series circuit with said device for blocking high-frequency current to said primary winding;

a second capacitor and a second rectifier element connected in a second series circuit with said device for blocking high-frequency current to said primary winding;

a voltage responsive switching device connected in a closed-loop series circuit with said second capacitor and said primary winding, whereby when said second capacitor is charged to the breakdown voltage of said switching device, said switching device becomes conductive to provide a discharge path for said second capacitor through said primary winding, thereby to induce in a secondary winding of said transformer a high voltage pulse for igniting said discharge lamp through said output terminals; and an inhibiting circuit for inhibiting the action of said second capacitor and starting of said lamp after a predetermined interval if said lamp has not ignited, said inhibiting circuit comprising a controlled switching device connected across said second capacitor for discharging said second capacitor when a predetermined voltage is applied to a control terminal of said controlled switching device, and a third capacitor connected to said control terminal for applying said predetermined voltage to said control terminal.

11. An apparatus as claimed in claim 10, wherein said third capacitor is connected to said second capacitor so as to be charged by said second capacitor.

12. An apparatus as claimed in claim 11, further comprising at least one breakdown diode connected between said second and third capacitors to prevent said third capacitor from being charged during normal operation of said high intensity discharge lamp.

13. An apparatus as claimed in claim 10, further comprising a charging circuit for charging said third capacitor, said charging circuit including a resistor in series with said third capacitor for establishing the charging time needed to reach said predetermined voltage.

14. An apparatus as claimed in claim 10, wherein said controlled switching device comprises a field effect transistor.

15. A method for starting and operating a high intensity discharge lamp, comprising the steps of:

receiving an input AC voltage waveform from an AC source;

during a first polarity half-cycle of said input AC voltage waveform, charging a first capacitance through a first rectifier element;

during a second polarity half-cycle of said input AC voltage waveform, charging a second capacitance through a second rectifier element and transferring charge from said first capacitance to said second capacitance;

repeating the preceding method steps to stepwise charge said second capacitance until said second capacitance reaches a predetermined potential in excess of the peak magnitude of said input AC voltage waveform;

upon said second capacitance reaching said predetermined potential, discharging said second capacitance through a primary winding of a step-up transformer to induce a high voltage pulse in a secondary winding of said transformer;

coupling said high voltage pulse to said high intensity discharge lamp to ignite said lamp;

repeating the preceding method steps to generate and couple a plurality of successive high voltage pulses to said high intensity discharge lamp;

establishing a predetermined time interval by causing current to flow through a temperature dependent resistance until a predetermined resistance level is reached;

terminating the generation and coupling of high voltage pulses to said high intensity discharge lamp after said predetermined time interval has expired; and causing current to continue to flow through said temperature dependent resistance after said predetermined time interval has expired to maintain said predetermined resistance level, without said current flowing as charging current to either of said first or second capacitances.

16. A method as claimed in claim 15, wherein said temperature dependent resistance comprises a positive temperature coefficient resistance through which at least one of said first and second capacitances is charged, and wherein the step of terminating the generation and coupling of high voltage pulses to said high intensity discharge lamp comprises increasing the resistance of said positive temperature coefficient resistor to prevent said second capacitance from being charged to said predetermined potential.

17. A method for starting and operating a high intensity discharge lamp, comprising the steps of:

receiving an input AC voltage waveform from an AC source;

during a first polarity half-cycle of said input AC voltage waveform, charging a first capacitance through a first rectifier element;

during a second polarity half-cycle of said input AC voltage waveform, charging a second capacitance through a second rectifier element and transferring charge from said first capacitance to said second capacitance;

repeating the preceding method steps to stepwise charge said second capacitance until said second capacitance reaches a predetermined potential in excess of the peak magnitude of said input AC voltage waveform;

upon said second capacitance reaching said predetermined potential, discharging said second capacitance through a primary winding of a step-up transformer to induce a high voltage pulse in a secondary winding of said transformer;

coupling said high voltage pulse to said high intensity discharge lamp to ignite said lamp;

repeating the preceding method steps to generate and couple a plurality of successive high voltage pulses to said high intensity discharge lamp;

establishing a predetermined time interval by causing current to flow into a third capacitance through a resistance until a predetermined control voltage is reached;

coupling said control-voltage to the control input of a controlled switching device to place said controlled switching device into conduction; and terminating the generation and coupling of high voltage pulses to said high intensity discharge lamp after said predetermined time interval has expired by discharging at least one of said first and second capacitances through said conducting controlled switching device.

18. A method as claimed in claim 17, further comprising the step 9 of inhibiting the charging of said third capacitance during normal operation of said high intensity discharge lamp.

19. A method as claimed in claim 18, wherein:

the step of causing current to flow into said third capacitance is carried out by applying a potential from said second capacitance across said third capacitance and said resistance; and the step of inhibiting the charging of said third capacitance during normal Operation of said high intensity discharge lamp comprises reducing said applied potential by a fixed value that is sufficient to prevent said third capacitance from reaching said predetermined control voltage.

20. An apparatus for starting and operating a high intensity discharge lamp, comprising the combination of:

a pair of input terminals for supplying voltage to the apparatus;

a pair of output terminals for connection to said high intensity discharge lamp;

a step-up transformer for coupling said input terminals to said output terminals;

a voltage multiplier circuit coupled to a primary winding of said transformer, said voltage multiplier circuit comprising:

a device for blocking high-frequency current;

a first capacitor and a first rectifier element connected in a first series circuit with said device for blocking high-frequency current to said primary winding;

a second capacitor and a second rectifier element connected in a second series circuit with said device for blocking high-frequency current to said primary winding;

a voltage responsive switching device connected in a closed-loop series circuit with said second capacitor and said primary winding, whereby when said second capacitor is charged to the breakdown voltage of said switching device, said switching device becomes conductive to provide a discharge path for said second capacitor through said primary winding, thereby to induce in a secondary winding of said transformer a high voltage pulse for igniting said discharge lamp through said output terminals; and an inhibiting circuit for inhibiting the action of said second capacitor and starting of said lamp after a predetermined interval if said lamp has not ignited, said inhibiting circuit comprising a positive temperature coefficient resistor connected in series with at least one of said first and second series circuits, a third rectifier element connected between said positive temperature coefficient resistor and said primary winding for conducting a heating current through said positive temperature coefficient resistor during alternate half-cycles of said supply voltage, and a current limiting resistor connected in series with said positive temperature coefficient resistor and said third rectifier element for limiting the heating current through said positive temperature coefficient resistor.

21. An apparatus as claimed in 20, further comprising a second device for blocking high-frequency current connected in series with said positive temperature coefficient resistor, said third rectifier element and said current limiting resistor.

* * * * *